US011045804B2

(12) United States Patent
Weber

(10) Patent No.: US 11,045,804 B2
(45) Date of Patent: Jun. 29, 2021

(54) MICROFLUIDIC FLOW CELL HAVING A STORAGE SPACE THAT HOLDS LIQUID REAGENT MATERIAL AND/OR SAMPLE MATERIAL

(71) Applicant: THINXXS MICROTECHNOLOGY AG, Zweibrücken (DE)

(72) Inventor: Lutz Weber, Merchweiler (DE)

(73) Assignee: THINXXS MICROTECHNOLOGY AG, Zweibrücken (DE)

( * ) Notice: Subject to any disclaimer, the term of this patent is extended or adjusted under 35 U.S.C. 154(b) by 185 days.

(21) Appl. No.: 16/314,539

(22) PCT Filed: May 24, 2017

(86) PCT No.: PCT/EP2017/062609
§ 371 (c)(1),
(2) Date: Dec. 31, 2018

(87) PCT Pub. No.: WO2018/001648
PCT Pub. Date: Jan. 4, 2018

(65) Prior Publication Data

US 2019/0321822 A1 Oct. 24, 2019

(30) Foreign Application Priority Data

Jun. 30, 2016 (EP) ..... 16177162
Sep. 22, 2016 (EP) ..... 16190102

(51) Int. Cl.
*B01L 3/00* (2006.01)

(52) U.S. Cl.
CPC ... *B01L 3/502715* (2013.01); *B01L 3/502746* (2013.01); *B01L 2200/027* (2013.01); *B01L 2200/16* (2013.01); *B01L 2300/044* (2013.01); *B01L 2300/047* (2013.01); *B01L 2300/0867* (2013.01); *B01L 2300/0877* (2013.01); *B01L 2300/0883* (2013.01); *B01L 2300/161* (2013.01)

(58) Field of Classification Search
CPC .. B01L 3/502715; B01L 3/5027; B01L 3/502; B01L 3/50; B01L 3/00; B01L 2200/027; B01L 2200/026; B01L 2200/02; B01L 2200/00
USPC ..... 422/502, 500, 50
See application file for complete search history.

(56) References Cited

U.S. PATENT DOCUMENTS

| | | | | |
|---|---|---|---|---|
| 9,421,540 | B2 | 8/2016 | Delamarche et al. | |
| 2002/0036018 | A1* | 3/2002 | McNeely | B01J 19/0093 137/806 |
| 2011/0151578 | A1* | 6/2011 | Abate | B01L 3/502784 436/180 |
| 2013/0149791 | A1 | 6/2013 | Hong et al. | |
| 2014/0051062 | A1* | 2/2014 | Vanapalli | G01N 35/1002 435/2 |
| 2016/0167047 | A1* | 6/2016 | Weber | B01L 3/5027 435/309.1 |

FOREIGN PATENT DOCUMENTS

| | | | |
|---|---|---|---|
| EP | 2821138 | A1 | 1/2015 |
| WO | 2012056334 | A1 | 5/2012 |
| WO | 2015162060 | A1 | 10/2015 |

OTHER PUBLICATIONS

WO 2015 162 060 A1 English Machine Translation, obtained on Aug. 25, 2020, from https://worldwide.espacenet.com/publicationDetails/description?CC=WO&NR=2015162060A1&KC=A1&FT=D&ND=3&date=20151029&DB=EPODOC&locale=en_EP# (Year: 2020).*

* cited by examiner

*Primary Examiner* — Christine T Mui
(74) *Attorney, Agent, or Firm* — Lucas & Mercanti, LLP; Klaus P. Stoffel

(57) ABSTRACT

A microfluidic flow cell, which has a storage space, which holds liquid reagent material and/or sample material and which is connected to an inlet channel for a fluid that transports the reagent material and/or sample material out of the storage space and to an outlet channel for the reagent material and/or sample material and the fluid. The inlet channel and the outlet channel are connected by a bypass that bypasses the storage space.

13 Claims, 2 Drawing Sheets

MICROFLUIDIC FLOW CELL HAVING A STORAGE SPACE THAT HOLDS LIQUID REAGENT MATERIAL AND/OR SAMPLE MATERIAL

The present application is a 371 of International application PCT/EP2017/062609, filed May 24, 2017, which claims priority of EP 161 77 162.1, filed Jun. 30, 2016, and EP 161 90 102.0, filed Sep. 22, 2016, the priority of these applications is hereby claimed and these applications are incorporated herein by reference.

BACKGROUND OF THE INVENTION

The invention relates to a microfluidic flow cell having a storage space which receives liquid reagent material and/or sample material and which is connected to an inlet channel for a fluid transporting the reagent material and/or sample material out of the storage space and to an outlet channel for the reagent material and/or sample material and the fluid.

Microfluidic flow cells, as are used mainly in life sciences for diagnosis, analysis and synthesis, process smaller and smaller volumes of liquid samples and liquid reagents.

SUMMARY OF THE INVENTION

The object of the invention is to make available a novel microfluidic flow cell which is of the aforementioned type and which is particularly suitable for receiving and processing small quantities of reagent material and/or sample material.

The microfluidic flow cell achieving this object according to the invention is characterized in that the inlet channel and the outlet channel are connected by a bypass that bypasses the storage space.

This inventive solution advantageously permits targeted transport and targeted mixing of the reagent material and/or sample material stored in a storage space of the flow cell by and with the fluid that is to be transported.

A quantity of sample or reagent to be processed is normally made available in a channel portion of a microfluidic network. Typical volumes are in the range of 1-100 μl. Processing of the sample or reagent quantity is understood, for example, as mixing with another sample or another reagent or, for example, dilution in the ratio of typically 1:1 to 1:1000, or controlled onward transport. The transport liquid or processing liquid or dilution liquid is in this case typically made available at another position of the microfluidic network away from the position of the sample, e.g. a storage region or liquid blister. That is to say, between the two quantities of liquid, there is an empty channel-shaped inlet region generally filled with gas or air.

Seen in the direction of flow, the bypass preferably branches off from the Inlet channel directly upstream from the storage space. In this way, no air cushion can form between the leading edge of the fluid flowing in the inlet channel and the reagent material and/or sample material contained in the storage space, which air cushion transports the reagent material and/or sample material out of the storage space before it is reached by the leading edge of the incoming fluid.

In a further advantageous embodiment of the invention, the storage space forms a channel portion in alignment with the inlet channel and the outlet channel. By matching the directions of flow in the inlet channel and outlet channel and also in the storage space, the reagent material and/or sample material is quickly flushed out completely from the storage space.

Preferably, the cross section of the storage space, perpendicular to the direction of flow, corresponds to the cross section of the inlet channel and/or the cross section of the outlet channel. Alternatively, the cross section of the storage space, perpendicular to the direction of flow, can be smaller or larger than the cross section of the inlet channel and/or the cross section of the outlet channel.

While it would be possible that the cross section of the storage space, perpendicular to the direction of flow, changes in the direction of flow, it is constant in a preferred embodiment of the invention.

The flow cross section of the bypass can in particular be dimensioned such that a desired fraction of the fluid flowing through the inlet channel flows via the bypass, wherein the fraction corresponds to a desired mixing ratio of reagent material and/or sample material and fluid.

In a further embodiment of the invention, the flow cross section of the bypass is just sufficient for venting the inlet channel in order to prevent reagent material and/or sample material from being transported out of the storage space by air pressure rising in the inlet channel.

In one embodiment of the invention, the bypass can be produced by deflection of a flexible cover film bordering the storage space.

The cover film can be deflected pneumatically, for example by the air pressure in the inlet channel or by a suction pressure generated from outside by an operator device or alternatively mechanically.

In a particularly preferred embodiment of the invention, the inlet channel, the outlet channel and optionally the storage space are formed by recesses in a substrate, and the recesses are closed in a fluid-tight manner by a cover connected to the substrate. The cover is preferably a cover film welded and/or adhesively bonded to a panel face of the substrate, or else a preferably injection-molded cover substrate.

In another particularly preferred embodiment of the invention, the storage space is adjoined by a carrier element which receives the liquid reagent material and/or sample material and which, in order to close the storage space in a fluid-tight manner, can be inserted into an opening in the substrate and can be connected in a fluid-tight manner to the substrate.

Advantageously, by means of such a carrier element, samples or reagents can finally be inserted into the otherwise fully produced flow cell. Deterioration of reagents introduced into a storage space in the substrate by subsequent welding and/or adhesive bonding of the substrate, e.g. with a cover film, is avoided.

A receiving region of the carrier element for the reagent material and/or sample material, which receiving region borders the storage space, is expediently formed in an endpiece of a plug-like carrier element.

The bypass can expediently extend between the endpiece and the inner wall of the abovementioned opening.

The invention is explained in more detail below on the basis of illustrative embodiments and with reference to the accompanying drawings relating to these illustrative embodiments, in which:

DETAILED DESCRIPTION OF THE INVENTION

Figure 1:
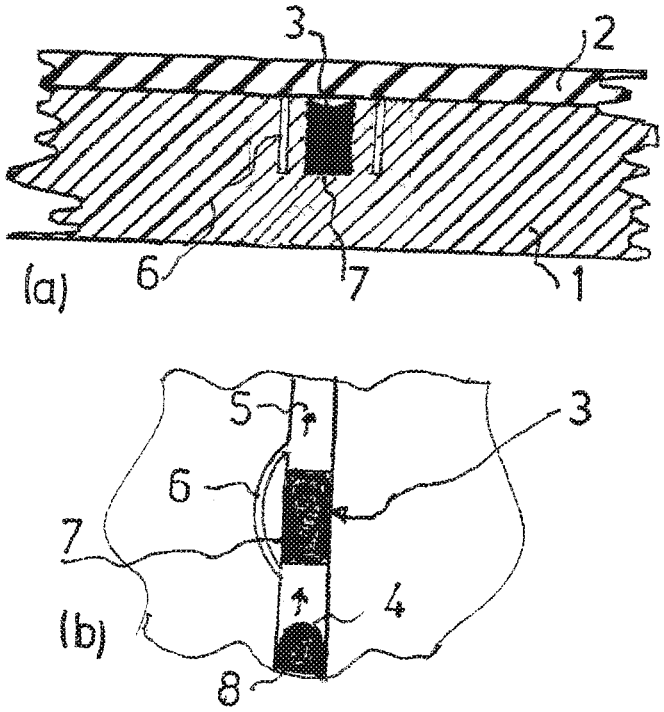
FIG. 1 shows an illustrative embodiment of a flow cell according to the invention with a storage space bound by a substrate and a cover film.

A microfluidic flow cell shown in part in FIG. 1 comprises a panel-shaped substrate 1 and a cover film 2 welded and/or adhesively bonded to the substrate 1. The cover film 2 provides a fluid-tight closure for cavity structures of the flow cell that are formed in the substrate 1 and are open toward the film side.

Of these cavity structures, FIG. 1 shows a storage space 3, an inlet channel 4 and an outlet channel 5. Next to the storage space 3, a bypass 6 branching off from the inlet channel 4 directly upstream from the storage space 3 in the direction of flow connects the inlet channel 4 to the outlet channel 5.

In the example shown, the storage space 3 has the same cross section in the direction of flow as the inlet channel and the outlet channel, such that the storage space 3 forms only a portion of a continuous channel. However, in contrast to the channel walls, the walls of the storage space 3 are at least partially hydrophilized, such that liquid reagent material 7 can be held in place there and can be introduced into the flow cell in the course of production of the flow cell. The volume of the liquid reagent material 7 is preferably in the range of 1-100 μl, in particular in the range of 2-50 μl. The storage region 3 can be separated (not shown) from the inlet channel and outlet channel by means of local welds acting as a predetermined break point and connecting the substrate to the cover film 2. The storage region 3 could additionally be connected to closable filling and venting channels (not shown) for introducing the reagent material 7 into the storage region.

Depending on the function of the flow cell, a further fluid introduced from outside into the flow cell or fluid originating from a further storage region of the flow cell can flow in through the inlet channel 4, flushes the reagent material 7 out of the storage space 3 and, by way of the outlet channel 5, feeds the reagent material 7, mixed with the further fluid, to a site for further processing inside the flow cell.

The further fluid 8 can be, for example, a sample liquid to be examined by the flow cell or a further liquid reagent, e.g. a wash buffer or dilution buffer. The further fluid 8 can also entail mixtures composed of a sample liquid and of a liquid reagent.

It will be appreciated that the flow cell itself or an operator device has a pressure source (not shown) for transporting fluid through the inlet channel 4, the storage space 3 and the outlet channel 5. Such a pressure source could be formed, for example, by a blister for a wash buffer and dilution buffer. Alternatively, it would be possible to use as pressure source a region of the flow cell that is elastically or plastically deformable from outside by an operator device or manually by a user, or an air pump of an operator device attachable via an air connection or pneumatic connection of the flow cell.

The fluid flowing in for the purpose of flushing out the reagent material 7 from the storage space 3 displaces before it the air contained in the inlet channel 4. Without the bypass 6, an undesired air cushion would arise between the reagent material 7 and the incoming fluid and would impair the mixing of reagent material and fluid. The flow resistance of the bypass 6 for the air is so low that the air pressure upstream from the storage space 3 in the direction of flow cannot increase to such an extent that the air is able to force the reagent material 7 out of the storage space 3 against the holding capacity of the storage space. The leading edge of the fluid 8 thereby reaches the reagent 7 and, mixing with the reagent 7, flushes the reagent 7 out of the storage space 3.

By contrast, in the example in FIG. 1, the flow resistance of the bypass 6 for the fluid 8 is so low that no appreciable fraction of the incoming fluid 8 flows past the storage space 3 via the bypass 6. It will be appreciated that the fraction of the fluid 8 flowing through the bypass increases when the flow resistance of the bypass 6 for the fluid 8 decreases through enlargement of the bypass cross section. With a view to more rapid mixing of reagent material 7 and fluid 8, a desired fraction of the fluid flowing through the bypass 6 can be adjustable by selection of the cross section of the flow source.

FIGS. 2 to 7 show illustrative embodiments which, in order to form a storage space 3 for liquid reagent material and/or sample material 7, use a carrier element 9 which can be inserted into an opening 10 in the flow cell or the substrate 1 thereof and can be connected to the flow cell in a fluid-tight manner. In the same way as in the illustrative embodiment of FIG. 1, channels are connected to the storage space 3.

The carrier element 9, formed like a plug with a cylindrical endpiece 11, a cone portion 12 and a collar 13, has a receiving groove 14 which is open toward the front face and is provided for liquid reagent material and/or sample material. The opening 10 in the substrate 1 of the flow cell is adapted in shape approximately to the carrier element 9. The groove 14 is hydrophilized, such that the liquid reagent material and/or sample material is held particularly securely on the carrier element in the groove 14.

In the state when inserted into the flow cell, the carrier element 9 reaches with the front face of the cylindrical endpiece 11 possibly as far as the cover film 2, such that the carrier element 9 together with the cover film 2 forms the storage space 3. The cross section of the storage space corresponds to the cross section of an inlet channel (not visible in FIGS. 2 to 7) opening into the storage space and to that of an outlet channel. Of said channels, the outlet channel 5 is visible in cross section in FIG. 2*a*. In a suitable position of rotation of the carrier element 9, the storage space 3 is aligned with the channels. To secure the alignment of the storage space 3 with respect to the channels, an abutment could be formed respectively on the carrier element 9 and on the substrate 1.

Since the diameter of the endpiece 11 is smaller than the diameter of the portion of the opening 10 in the substrate 1 receiving the endpiece 11, a bypass 6 composed of two flow channels is formed.

The storage space is closed off from the outside in a fluid-tight manner by the cone portion 12 of the carrier element 9. In addition to the cone closure, the carrier element 9 could be welded and/or adhesively bonded to the substrate 1 in a fluid-tight manner.

Compared to the illustrative embodiment of FIG. 1, the Illustrative embodiments of FIGS. 2 to 7 have the advantage that the reagent material and/or sample material is not adversely affected by final welding and/or adhesive bonding of the substrate 1 to the cover film 2.

Figure 2:
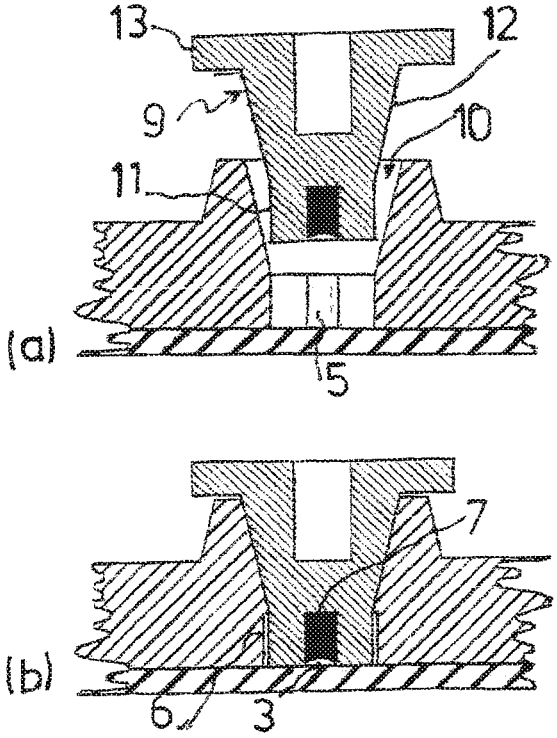
FIGS. 2 to 4 show flow cells according to the invention with a storage space delimited by a carrier element and a cover film and with bypass channels extending between the carrier element and a substrate.
Figure 3:
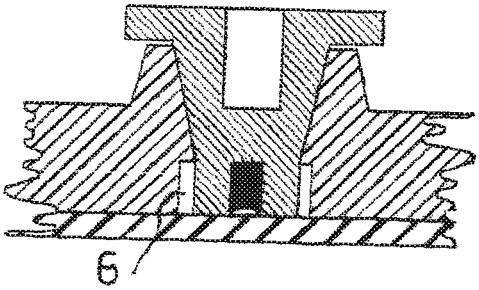

The illustrative embodiment of FIG. 3 differs from the Illustrative embodiment of FIG. 2 in that the difference between the diameter of the endpiece 11 and the portion of the opening 10 receiving the endpiece 11 is still greater than in the illustrative embodiment of FIG. 2 and therefore the flow cross section of the bypass 6 formed is greater than the flow cross section of the bypass 6 of the illustrative embodiment of FIG. 2. Accordingly, by means of the bypass according to FIG. 3, a greater fraction of a fluid flowing through the inlet channel can flow via the bypass, and, as has already been mentioned above, the mixing ratio of reagent liquid and/or sample liquid with the incoming fluid can be suitably adjusted.

It will be appreciated that in the Illustrative embodiment of FIG. 2, and also in the illustrative embodiment of FIG. 3, it would be possible to have a bypass extending over only half the circumference of the endpiece 11.

Figure 4:
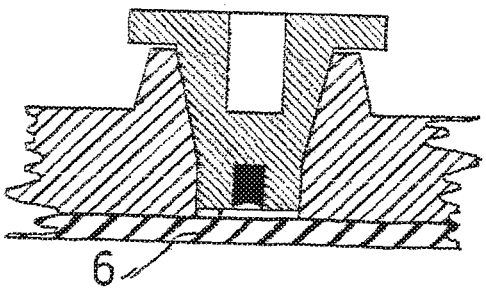

In a departure from the Illustrative embodiments of FIGS. 2 and 3, a bypass 6 according to the illustrative embodiment of FIG. 4 is formed by means of the conical endpiece 11 of the carrier element 9 being shortened and not reaching as far as the cover film 2.

Figure 5:
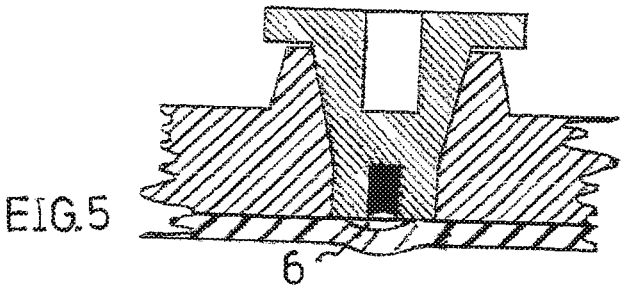
FIGS. 5 and 6 show illustrative embodiments of flow cells according to the invention with bypass channels which are formed by deflected cover films.
Figure 6:
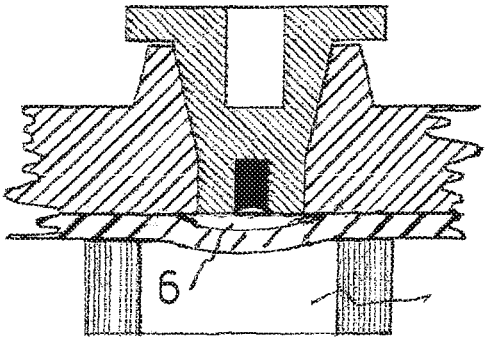

FIGS. 5 and 6 relate to Illustrative embodiments in which a cover film 2 in the region of a storage space 3 is deflectable in order to form a bypass 6. According to FIG. 5, the deflection of the cover film 2 is effected by the pressure of the air that is to be conveyed around it. According to the Illustrative embodiment of FIG. 6, a vacuum-generating operator device 15 is used to deflect the cover film 2 by suction effect.

Figure 7:
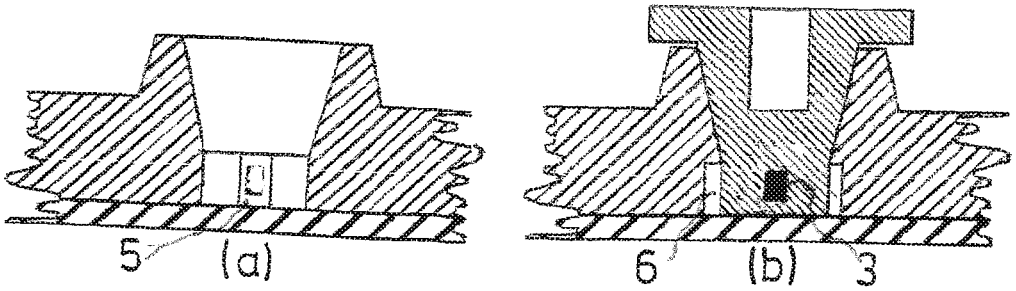
FIG. 7 shows an illustrative embodiment of a flow cell according to the invention with a storage space which is formed by a carrier element and which is narrowed in relation to flushing channels.

In an illustrative embodiment shown in FIG. 7, a cylindrical endpiece 11 of a carrier element 9 has no groove open toward the front face of the endpiece, but Instead a passage. The passage forms a storage space 3 whose cross section is smaller than the cross section of the channels opening into the storage space, of which FIG. 7*a* shows the outlet channel 5 in cross section. The storage space 3, indicated in its position by broken lines in FIG. 7*a*, is aligned approximately with the center of the cross section of the channels opening into it.

Fluid flowing in through the inlet channel via the bypass with a relatively large flow cross section encloses the reagent material and/or sample material in the outlet channel 5 in the flow, resulting in a kind of centering of the reagent material and/or sample material in the fluid flushing out the storage space 3. In this way, for example, a sample with particles, e.g. the cells of a blood sample, can be centered in the outlet channel, for example in order to analyze it individually according to the principle of a cytometer.

The substrate 1 and the carrier element 9 of the above-described flow cells are preferably made of plastics, such as PMMA, PC, COC, COP, PPE, PE, and are produced by injection molding. The materials of substrate 1 and carrier element 9 preferably correspond.

The invention claimed is:

1. A microfluidic flow cell, comprising: a storage space in which a liquid reagent material and/or liquid sample material is stored; an inlet channel connected to the storage space for guiding a liquid to the storage space to transport the liquid reagent material and/or liquid sample material out of the storage space; an outlet channel connected to the storage space for receiving the liquid together with the liquid reagent material and/or liquid sample material; and a bypass that connects the inlet channel and the outlet channel and bypasses the storage space, wherein the bypass directly branches upstream of the storage space, the storage space forming a channel portion in alignment with the inlet channel and to the outlet channel, wherein, perpendicular to a direction of flow, the channel portion has a cross-section that is equal to or smaller than a respective cross-section of the inlet channel and the outlet channel, and wherein the channel portion is at least partially hydrophilized so as to hold the liquid reagent material and/or liquid sample material within the storage space.

2. The flow cell according to claim 1, wherein the bypass branches off from the inlet channel directly upstream from the storage space in a direction of flow.

3. The flow cell according to claim 1, wherein the storage space has a cross section perpendicular to a direction of flow that corresponds to a cross section of the inlet channel and/or a cross section of the outlet channel.

4. The flow cell according to claim 1, wherein the storage space has a cross section perpendicular to a direction of flow that is constant in a direction of flow.

5. The flow cell according to claim 1, wherein the bypass has a flow cross section dimensioned so that a desired fraction of fluid flowing in through the inlet channel flows via the bypass.

6. The flow cell according to claim 1, wherein the bypass has a flow cross section just sufficient to vent the inlet channel in order to prevent reagent material and/or sample material from being transported out of the storage space by air pressure rising in the inlet channel.

7. The flow cell according to claim 1, further comprising a flexible cover film bordering the storage space, wherein the bypass is formed by deflection of the flexible cover film bordering the storage space.

8. The flow cell according to claim 7, wherein the cover film is deflected by air pressure in the inlet channel or by suction pressure generated from outside by an operator device.

9. The flow cell according to claim 1, wherein the inlet channel, the outlet channel and optionally the storage space are formed by recesses in a substrate, and the recesses are closed in a fluid-tight manner by a cover connected to the substrate.

10. The flow cell according to claim 9, wherein the cover is a cover film welded and/or adhesively bonded to a panel face of the substrate.

11. The flow cell according to claim 9, wherein the storage space is adjoined by a carrier element that receives the liquid reagent material and/or sample material and which, in order to close the storage space in a fluid-tight manner, is insertable into an opening in the substrate and is connectable in a fluid-tight manner to the substrate.

12. The flow cell according to claim 11, wherein the storage space is bordered by a receiving region of the carrier element for the reagent material and/or sample material, which receiving region is formed in an endpiece of a plug-like carrier element.

13. The flow cell according to claim 12, wherein the bypass extends between the endpiece and an inner wall of the opening.

* * * * *